United States Patent [19]

Mulvihill

[11] Patent Number: 4,541,186

[45] Date of Patent: Sep. 17, 1985

[54] GYMNASTIC SHOE WITH CUSHIONING AND SHOCK ABSORBING INSERT

[75] Inventor: Richard J. Mulvihill, Eugene, Oreg.

[73] Assignee: Nike, Inc., Beaverton, Oreg.

[21] Appl. No.: 482,581

[22] Filed: Apr. 6, 1983

[51] Int. Cl.[4] ..... A43B 13/38; A43B 13/42; A43B 5/00

[52] U.S. Cl. ..... 36/114; 36/44; 36/43; 36/71; 128/614

[58] Field of Search ..... 36/43, 44, 71, 25 R, 36/30 R, 68, 69, 114, 91, 92; 128/614, 615, 617, 621

[56] References Cited

U.S. PATENT DOCUMENTS

| | | | |
|---|---|---|---|
| 564,767 | 7/1896 | Schneider . | |
| 1,754,054 | 4/1930 | Selva . | |
| 1,774,122 | 8/1928 | Keeling . | |
| 1,813,561 | 7/1931 | Capezio . | |
| 1,872,641 | 8/1932 | Capezio . | |
| 1,953,659 | 4/1934 | Savino . | |
| 1,973,402 | 9/1934 | Bohmbach | 128/614 |
| 1,996,083 | 4/1935 | Smith . | |
| 2,113,183 | 4/1938 | Sanchion | 36/43 |
| 2,619,743 | 12/1952 | Harris . | |
| 2,626,610 | 12/1971 | Dassler . | |
| 2,773,316 | 12/1956 | Clappier | 36/30 R |
| 2,897,611 | 8/1959 | Schaller | 36/44 |
| 3,602,931 | 9/1971 | MacArthur | 36/68 |
| 3,647,616 | 3/1972 | Zemlin | 36/68 |
| 3,828,792 | 8/1974 | Valenta | 128/614 |
| 4,055,699 | 10/1977 | Hsiung | 36/44 |
| 4,224,750 | 9/1980 | Delport . | |
| 4,227,321 | 10/1982 | Kling . | |
| 4,232,457 | 11/1980 | Mosher . | |
| 4,277,897 | 7/1981 | O'Connell . | |
| 4,408,402 | 10/1983 | Looney | 36/44 |
| 4,435,910 | 3/1984 | Marc | 36/44 |

FOREIGN PATENT DOCUMENTS

| | | | |
|---|---|---|---|
| 2907506 | 9/1980 | Fed. Rep. of Germany | 36/44 |
| 1207258 | 2/1960 | France | 36/44 |
| 16758 | of 1912 | United Kingdom | 36/44 |
| 170457 | 6/1921 | United Kingdom | 36/44 |

*Primary Examiner*—Werner H. Schroeder
*Assistant Examiner*—Steven N. Myers
*Attorney, Agent, or Firm*—Banner, Birch, McKie & Beckett

[57] ABSTRACT

A lightweight, flexible gymnastic shoe is disclosed. The shoe includes an upper formed of a lightweight synthetic fabric. A relatively broad closure strap has a first end fixed to a medial inside surface of the upper in the area of the arch and a second free end for detachable attachment to the medial outside of the upper. A hook and pile fastener selectively fastens the second end of the closure strap to the upper. A sole is attached to an outer bottom surface of the upper, and is formed of a relatively thin resilient material located only below the toe, ball and heel areas. A liner is located inside the upper and extends along substantially the entire length of the inside top surface of the upper. The liner is formed of a relatively low density cushioning material. A metatarsal pad is located along the liner only in the area of the first and second metatarsal heads of a wearer's foot, and a heel pad is located along the liner in the heel area. The pads are formed of a shock-absorbing material different from and having a higher density than the material of the liner. An arch support is formed of a built up area of material positioned below the medial arch area.

15 Claims, 10 Drawing Figures

GYMNASTIC SHOE WITH CUSHIONING AND SHOCK ABSORBING INSERT

TECHNICAL FIELD

The present invention relates to shoes, and in particular, to an athletic shoe used primarily for gymnastics or gymnastic like activities such as jazzercise and aerobic dance, which includes a lightweight, flexible, cushioning liner and shock-absorbing pads in selected areas.

BACKGROUND OF THE INVENTION

The modern athletic shoe is a combination of many elements which have specific functions, all of which must work together for the support and protection of the foot during an athletic event. The design of an athletic shoe has become a highly refined science. No longer do athletes and participants in sports events use a pair of "sneakers" for all sports. Athletic shoes today are as varied in design and purpose as are the rules for the sports in which the shoes are worn. Tennis shoes, racquetball shoes, basketball shoes, running shoes, baseball shoes, football shoes, gymnastic shoes, weight lifting shoes, etc., are all designed to be used in very specific, and very different, ways. They are also designed to provide a unique and specific combination of traction, support, and protection to enhance athletic performance. Not only are shoes designed for specific sports, they are also designed to meet the specific characteristics of the user. For example, athletic shoes are designed differently for heavier persons than for lighter persons. Some shoes are designed to correct physical problems, such as over-pronation, while others include devices, such as ankle supports or shock absorption devices, to prevent physical problems from developing.

An athletic shoe is divided into two general parts, an upper and a sole. The upper is designed to snugly and comfortably enclose the foot. The sole must provide traction, protection, and a durable wear surface.

The sport of gymnastics is physically demanding and cannot be compared with any other sport. Shoes required for gymnastics and similar indoor games and sports, such as aerobic dance and jazzercise, must have a unique combination of comfort, flexibility, shock absorption, protection and support. Accordingly, shoes designed for other sports are not appropriate as a general, all-purpose gymnastic shoe. Shoes currently used in gymnastics are slipper-type comprised of an upper with a thin outsole in the forefoot and heel areas and a non-cushioning cloth liner. Such slipper-type gymnastic shoes offer little protection against typical gymnastic foot injuries such as heel bruises, fallen arches, bruises along the ball of the foot, and tendon and ligament injuries. However, protective devices have not been incorporated into such slippers apparently because of the desire to keep the tactile sensitivity of the foot at a maximum.

The invention described and claimed herein overcomes the problems of prior art gymnastic slippers by providing a gymnastic shoe with a lightweight, flexible, cushioning and shock-absorbing insert which provides shock absorption under crucial parts of the foot, cushioning under the entire foot, adds to the integrity of the anterior capsule of the foot, offers heel support and protection, stability to the ankle, and generally protects the feet from injury. These supportive and protective elements have been judiciously incorporated into the shoe such that tactile sensitivity of the foot and performance capability have unexpectedly not been adversely affected.

SUMMARY OF THE INVENTION

The invention described and claimed herein comprises a lightweight, flexible gymnastic shoe having a cushioned, shock-absorbing insert. The term gymnastic is used herein to refer both to traditional gymnastic activities and similar activities such as aerobic dance and jazzercise. The shoe includes an upper, generally made from a lightweight nylon mesh material, and a sole attached to the upper. The upper has an opening and a throat to allow a foot to be easily inserted and removed. Combined closure and support means are provided for securely holding the upper on the foot and for adding support to the anterior capsule of the foot.

In a preferred embodiment the combined closure and support means comprises a wide strap covering a substantial part of the top surface of the midfoot attached to one side of the upper, preferably the medial side. The other side of the elastic strap is fastened, such as by a Velcro hook and pile fastener, to the other side of the upper. The wide elastic band adds integrity to the anterior capsule of the foot which prevents tendon and ligament injuries. The upper may also have a rigid heel counter made out of a soft, moldable material to add stability and protection to the heel.

The gymnastic shoe of the present invention also includes a flexible, cushioning and shock-absorbing insert, which may be removable. The insert is adapted to fit within the upper and includes a liner, a heel pad and a metatarsal pad. The liner is formed of a lightweight cushioning material, while the pads are formed of a shock absorbing, generally heavier material. The heel pad is positioned below the heel area of the foot to protect the heel from bruises and to help prevent shin splints which are common to gymnasts. The metatarsal pad is positioned only below the area of the first and second metatarsal heads of the foot. By protecting only the first two metatarsal heads, the liner still allows the user to grip with the toes and thus maintain the "feel" of the surface on which the exercise is being performed. This is especially important when an exercise is being performed on a balance beam, for example. The liner also has an area of reduced thickness under the area of the toes to provide additional feel and grip to the user. The liner may be provided with a cupped heel portion wherein the liner extends upward a slight distance around the sides and back of the heel to prevent bruises on the side of the heel.

Various advantages and features of novelty which characterize the invention are pointed out with particularity in the claims annexed hereto and forming a part hereof. However, for a better understanding of the invention, its advantages, and objects obtained by its use, reference should be had to the drawings which form a further part herreof, and to the accompanying descriptive matter, in which there is illustrated and described a preferred embodiment of the invention.

DESCRIPTION OF THE PREFERRED EMBODIMENT

Figure 1:
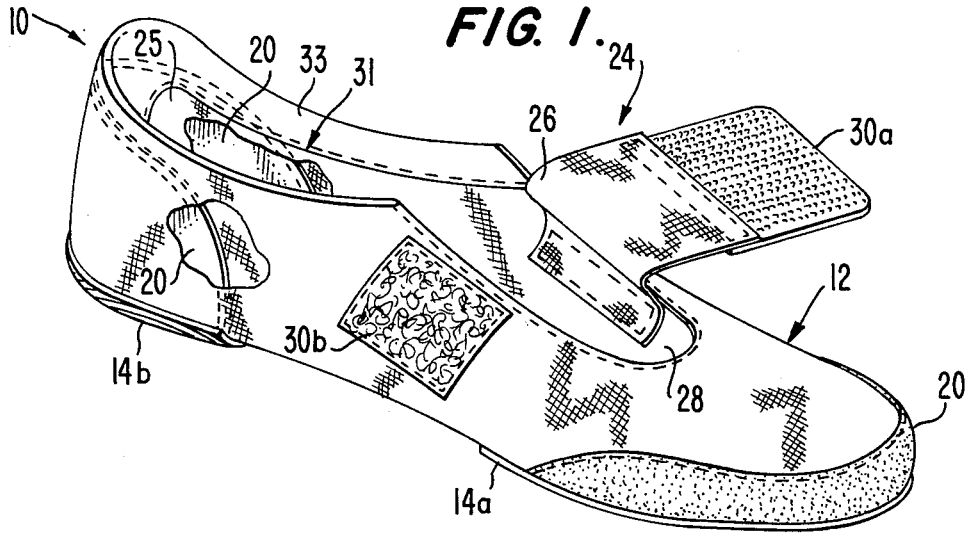
FIG. 1 is a perspective view of a gymnastic shoe according to the present invention.
Figure 2:
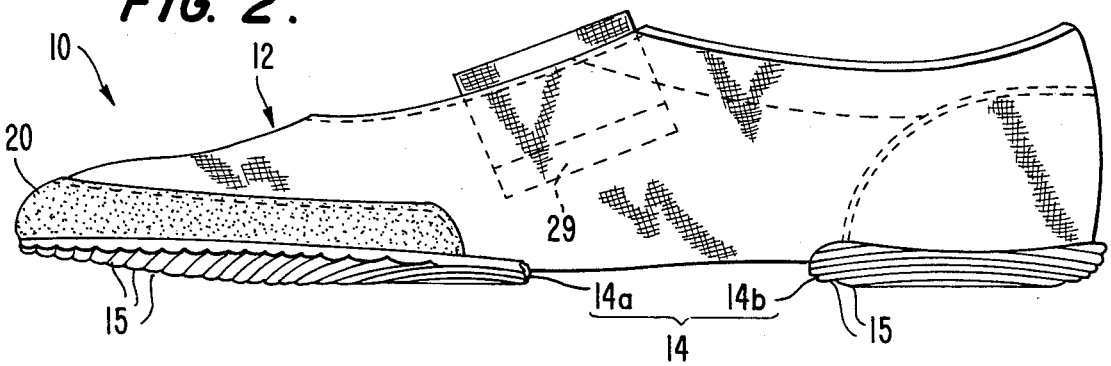
FIG. 2 is a medial side of the shoe.
Figure 3:
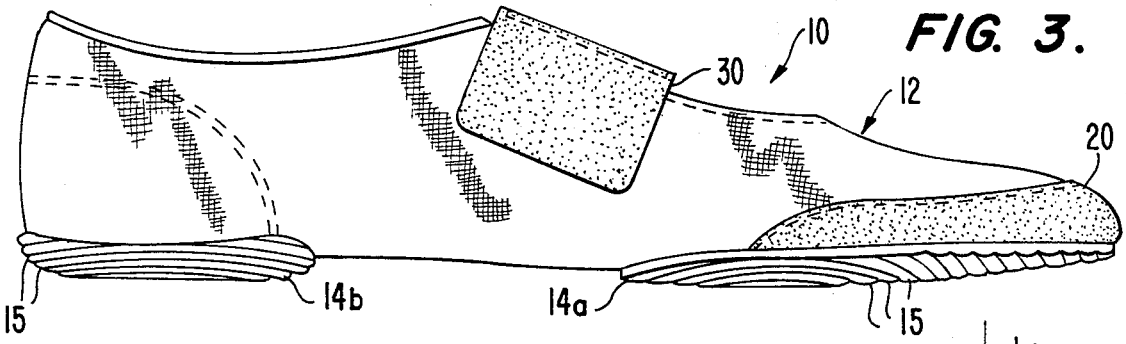
FIG. 3 is a lateral side view of the shoe.
Figure 4:
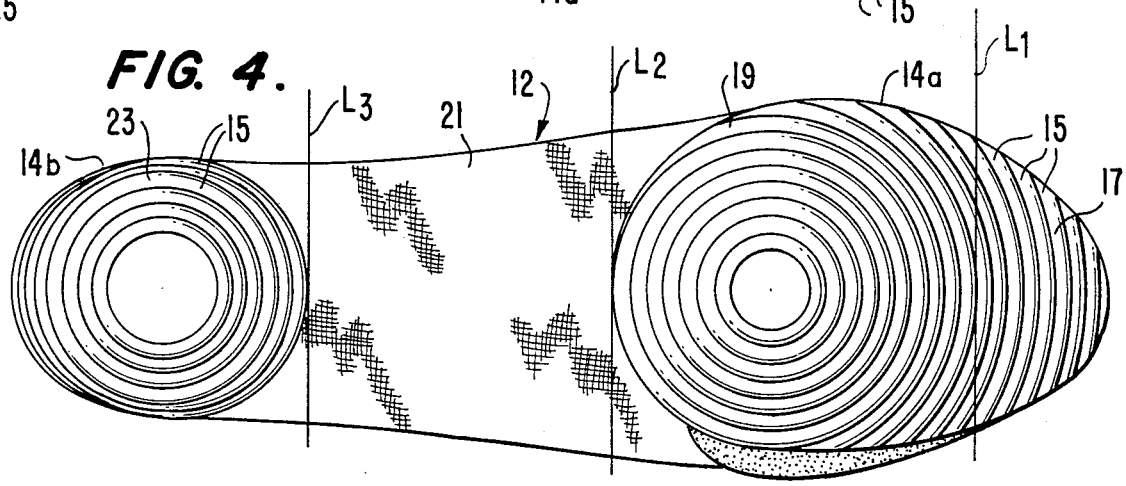
FIG. 4 is a bottom plan view of the shoe.
Figure 5:
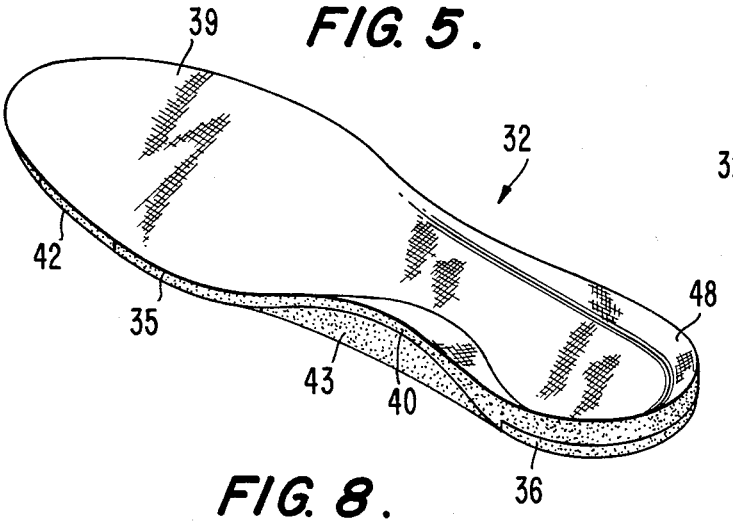
FIG. 5 is a perspective view of the insert according to the present invention.

A gymnastic shoe according to the present invention is shown generally at 10. Shoe 10 comprises an upper 12 made from a lightweight flexible material. A preferred material is a strong, flexible, lightweight, durable, closely knit nylon mesh which affords roominess and breathability. As seen in FIG. 4, shoe 10 can be divided into a toe area 17 in front of line $L_1$, a ball area 19 between lines $L_1$ and $L_2$, an arch area 21 between lines $L_2$ and $L_3$, and a heel area 23 back of line $L_3$. Areas 17, 19, 21 and 23 correspond approximately to the respective areas of a foot inserted into the shoe, however, lines $L_1$–$L_3$ are not intended to delineate precise lines of demarcation, but rather are approximations for purposes of discussing various structural and functional aspects of the invention.

Shoe 10 also includes a sole 14 preferably formed in two sections 14*a* and 14*b*. Sole 14 must be extremely flexible to allow the wearer to both "feel" and grip the surface on which an exercise is being performed. Sole 14 is thus preferably made of a flexible, relatively thin and durable rubber or similar synthetic material; for example, a urethane or rubber with a Shore A durometer hardness between approximately 50 and 75, and with a thickness between approximately 1.5 and 3.0 mm. Sole 14 also contributes to cushioning and shoe stability, provides traction, and protection for the foot. Traction is enhanced by forming concentric ribs 15 in the bottom surface of each sole section 14*a* and 14*b*. Sole sections 14*a* and 14*b* may be attached to upper 12 in any fashion which is conventional. In a preferred form sole sections 14*a* and 14*b* are glued to the bottom outer surface of upper 12. By forming sole 14 in two sections 14*a* and 14*b*, arch area 21 does not have sole material along its bottom surface. This has the advantage of reducing the weight of shoe 10 and preventing irritation of the foot by the sole material during pointing of the foot in gymnastic exercises.

Shoe 10 may also include a toe guard 20 which is formed of a thin piece of leather or man-made reinforcement material, and is attached to the outer surface of upper 12 along the side of ball and toe areas 17, 19 and in front of the toe area 17. The use of a toe guard is particularly desirable when upper 12 is formed of a two-way stretch fabric.

Shoe 10 includes a rigid heel counter 20 to add stability and protection to the heel area of the shoe and to provide a degree of control to rear foot motion. Counter 20 is made from a rigid material molded to the shape of the heel area of upper 12. The material of counter 20 is preferably softer than the typical counter material. Thus, if a gymnast lands with one foot on top of the other, the portion of counter 20 below the heel is less likely to bruise the lower foot. Counter 20 is attached to the interior surface of the upper and is covered by an additional layer of material 25.

Upper 12 includes closure and support means 24 for securely holding the upper on the foot and for adding support to the anterior capsule of the foot. In a preferred embodiment, closure 24 comprises a strap 26 fastened to the medial side of of upper 10 and a fastener 30 for attracting the free end of strap 26 to the outer surface of upper 12 on its lateral side. A slot or throat 28 is formed in upper 12 as an extension of opening 30 to facilitate inserting and removing a foot from shoe 10. Strap 26 may be fastened to the inside surface of throat 28 and the inside surface of upper 12 by stitching, as shown at 29, or by any other means conventional in the art. Strap 26 is formed of a relatively wide band of material, for example, one to two inches wide in order to add support to the anterior capsule of the foot. In one preferred form, strap 26 is made of an elastic material. Strap 26 is provided with one portion 30*a* of fastener 30 for fastening the free end of strap 26 to the outside of the opposite side of upper 12 by attachment to the other portion 30*b* of the fastener. In a preferred form, fastener 30 is a Velcro hook and pile type fastener with either the hook or pile attached to the free end of strap 26 and the other of the hook or pile attached to the outer surface of upper 12 on the lateral side of throat 28.

Upper 12 may also be provided with a padded ankle collar 33 to provide additional comfort and protection.

Shoe 10 includes a insert 32, shown in FIGS. 5–10, to provide enhanced support, protection, and stability to the wearer. Insert 32 may be removable from shoe 10 and includes a liner 35, a heel pad 36 and a metatarsal pad 42. As shown in FIGS. 5 through 10, insert 32 and liner 35 are shaped to fit within the foot bed of shoe 10. Liner 35 is preferably made from a lightweight, flexible, cushioning material such as a lightweight, low-density foam material; for example, an EVA-polyethylene blend which molds to the individual pressure pattern of the foot, for a comfortable, custom fit. Liner 35, however, may also be made of other lightweight, flexible cushioning materials as are well-known in the art. A suitable average thickness for liner 35 has been found to be between approximately 2 mm and 5 mm. For additional comfort, a layer of fabric 39 is attached to the upper surface of liner 35.

For protection of the foot in heel area 23, heel pad 36 is inserted below liner 35 and liner 35 is formed with a cupped heel portion 48. Heel pad 36 is formed of a high shock absorbant material to absorb the forces placed on the heel during gymnastic exercises. The material of heel pad 36 should be contrasted to the material of liner 35, which is relatively lightweight and cushioning and functions to provide comfort to a wearer during low stress activities. However, during higher stress activities liner 35 does not exhibit the shock-absorbing capability of pad 36. Current shock-absorbing materials are relatively dense and heavy and thus are unsuitable for use as a lightweight liner.

In a preferred form, heel pad 36 is made from the highly shock absorbant material sold under the trademark Sorbothane. Sorbothane is a visco-elastic polymer possessing the properites of both fluids and elastic solids. Other materials which exhibit high shock-absorbing properites could also be used. Heel pad 36 may be placed in a notch 38 in liner 35 under the heel area of the foot so that the bottom of liner 35 forms a smooth, flat surface. Heel pad 36, however, may also be attached to the liner 35 in any position and in any manner which is conventional in the art in order to provide shock absorption to the heel area of the foot.

The cupped heel portion 48 is formed as a raised area of liner 35 about the side and back perimeter of heel area 23. Heel portion 48 preferably extends upward only a slight distance, for example, one-quarter of an inch, and functions as an additional protection for the lower sides of the heel of a wearer.

An arch support 40 is positioned below the arch area of the foot, along its medial side. Arch support 40 is comprised of a built up area extending along the medial side of arch area 21 and provides support to the arch of a wearer in order to alleviate fallen arch problems. In the illustrated embodiment, the built up area is formed of an upwardly curved area of liner 35 and a block of cushioning support material 43 placed below the curved area. Alternatively, arch support 40 can be made completely integral with liner 35.

Figure 6:
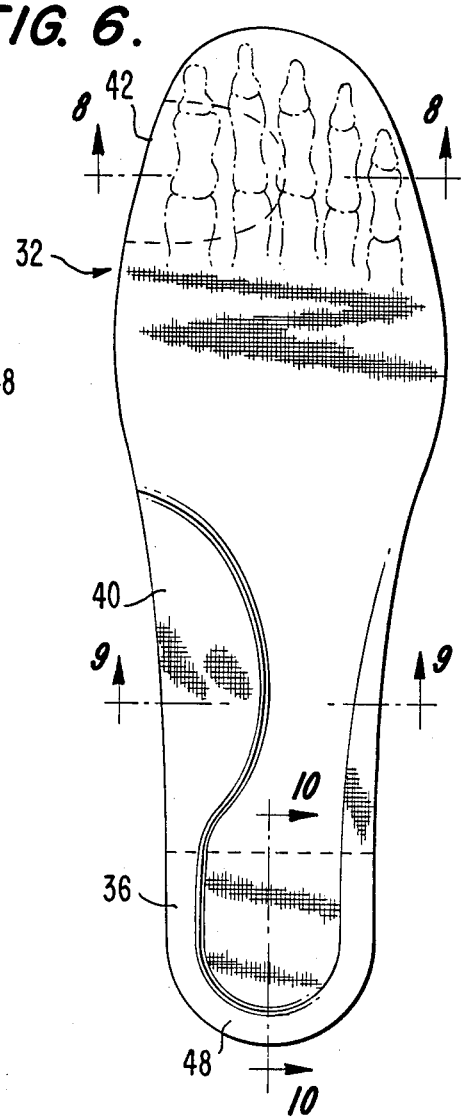
FIG. 6 is a top plan view of the insert showing the position of the toes and metatarsal heads in the shoe.
Figure 8:
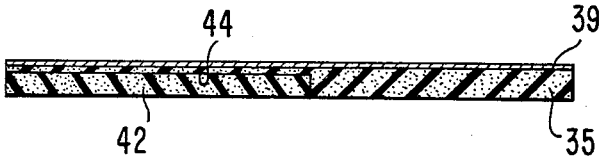
FIG. 8 is a cross-section taken generally along line 8—8 of FIG. 6.
Figure 9:
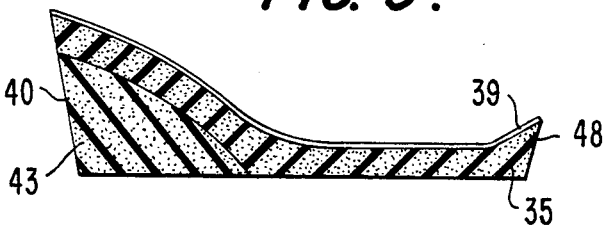
FIG. 9 is a cross-section taken generally along line 9—9 of FIG. 6.
Figure 10:
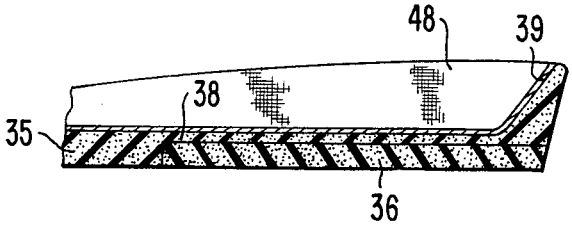
FIG. 10 is cross-section taken generally along line 10—10 of FIG. 6.

Metatarsal pad 42 is positioned only below the area of the first and second metatarsal heads of the foot, as shown clearly in FIG. 6. Metatarsal pad 42 is preferably made of the same type of material as heel pad 36, as discussed in detail above. Metatarsal pad 42 protects the area of the ball of the foot yet allows the wearer to grip the surface on which an exercise is being performed with the outside toes. This is extremely important in gymnastic events. Metatarsal pad 42 may be placed in a notch 44 formed on the bottom surface of liner 35 so that the bottom surface of liner 35 is flat and uniform. However, metatarsal pad 42 may be attached to liner 35 in any other fashion as is conventional in the art.

Figure 7:
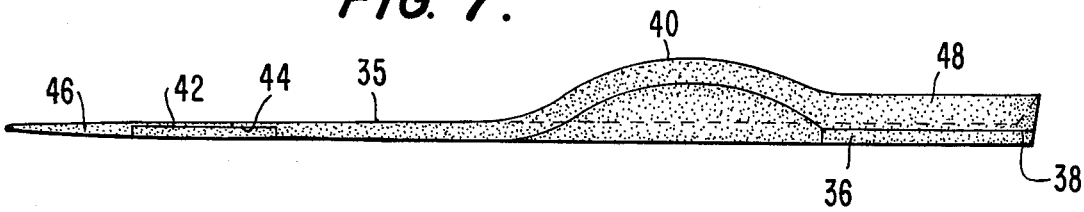
FIG. 7 is a medial side view of the insert.

Liner 35 has a region of reduced thickness under the area of the toes, as shown generally at 46 in FIG. 7. This area of reduced thickness is important to allow the user to maintain a "feel" of the surface on which an exercise is being performed and to be able to grip the surface with the toes, while still allowing the user a degree of cushioning and protection. Region 46 is preferably formed as a gradual taper, reducing in thickness from the back to the front of toe area 17. The placement of metatarsal pad 42 only beneath the first and second metatarsal heads, and the tapering of region 46 enable insert to provide comfort and a degree of protection without unduly affecting the tactile responsiveness of the foot.

Numerous characteristics and advantages of the invention have been set forth in the following description, together with details of the structure and function of the invention. The disclosure, however, is illustrative only, and changes may be made in detail, especially in matters of shape, size and arrangement of parts, within the principle of the invention, to the full extent indicated by the broad general meaning of the terms in which the appended claims are expressed.

I claim:

1. A lightweight, flexible gymnastic shoe comprising:

an upper formed of a lightweight synthetic fabric, said upper having an opening and a throat for the insertion of a foot into the shoe, and including toe, ball, arch and heel area corresponding to the respective portions of a wearer's foot;

a sole formed of a relatively thin resilient material and being attached to at least a portion of an outer bottom surface of said upper;

a liner located inside said upper and extending along substantially the entire length of the inside top surface of said upper, said liner being formed of a relatively low density cushioning material, said liner including a tapered portion which gradually becomes thinner from the back to the front of the toe area and a heel cup portion in which the liner extends upward around the sides and back of the heel area;

a metatarsal pad located along the liner only in the area of the first and second metatarsal heads of a wearer's foot, and a heel pad located along the liner in the heel area, said pads being formed of a shock-absorbing material different from and having a higher shock absorbing capability than the material of said liner; and an arch support formed of a built up area of material positioned below the medial arch area.

2. A gymnastic shoe according to claim 1 wherein said liner material is comprised of a synthetic foam material.

3. A gymnastic shoe according to claim 1 wherein said heel cup portion has a height of approximately one-quarter inch.

4. A gymnastic shoe according to claim 1 including combined closure and support means for securely holding said upper on the foot and for adding support to the anterior capsule of the foot.

5. A gymnastic shoe according to claim 1 wherein said metatarsal pad and said heel pad are attached to said liner in respective notches on the bottom side of said liner.

6. A gymnastic shoe according to claim 1 wherein said liner is removable from said shoe.

7. A gymnastic shoe according to claim 3 wherein said liner includes a layer of fabric attached to its upper surface.

8. A gymnastic shoe according to claim 1 wherein said sole is located only in the toe, ball and heel areas of the foot.

9. A gymnastic shoe according to claim 4 wherein said combined closure and support means comprises a strap covering a substantial part of the top surface of the midfoot attached to one side of said upper and fastening means for fastening said strap to the other side of said upper.

10. A gymnastic shoe according to claim 9 wherein said fastening means comprises a hook and pile fastener.

11. A lightweight, flexible gymnastic shoe comprising:

an upper formed of a lightweight synthetic fabric, said upper having an opening and a throat for the insertion of a foot into the shoe, and including toe, ball, arch and heel areas corresponding to the respective portions of a wearer's foot;

a relatively broad closure strap having a first end fixed to the medial inside of said upper in the area of the arch and a second free end for detachable attachment to the medial outside of said upper;

fastener means for selectively fastening said second end of said closure strap to said upper;

a sole attached to an outer bottom surface of said upper, said sole being formed of a relatively thin resilient material and being located only below the toe, ball and heel areas;

a liner located inside said upper and extending along substantially the entire length of the inside top surface of said upper, said liner being formed of a relatively low density cushioning material, said liner including a tapered portion which gradually becomes thinner from the back to the front of the toe area and a heel cup portion in which the liner extends upward around the sides and back of the heel area;

a metatarsal pad located along the liner only in the area of the first and second metatarsal heads of a wearer's foot, and a heel pad located along the liner in the heel area, said pads being formed of a shock-absorbing material different from and having a higher density than the material of said liner; and an arch support formed of a built up area of material positioned below the medial arch area.

12. A gymnastic shoe according to claim 11 wherein said liner material is comprised of a synthetic foam material.

13. A gymnastic shoe according to claim 11 wherein said heel cup portion has a height of approximately one-quarter inch.

14. A gymnastic shoe according to claim 11 wherein said closure strap is approximately one to two inches wide.

15. A gymnastic shoe according to claim 14 wherein said closure strap is comprised of an elastic band.

* * * * *